US007134488B2

(12) United States Patent
Tudor et al.

(10) Patent No.: US 7,134,488 B2
(45) Date of Patent: Nov. 14, 2006

(54) ISOLATION ASSEMBLY FOR COILED TUBING

(75) Inventors: Eric Hughson Tudor, De Winton (CA); William George Gavin, Calgary (CA)

(73) Assignee: BJ Services Company, Houston, TX (US)

( * ) Notice: Subject to any disclaimer, the term of this patent is extended or adjusted under 35 U.S.C. 154(b) by 111 days.

(21) Appl. No.: 10/829,601

(22) Filed: Apr. 22, 2004

(65) Prior Publication Data

US 2005/0236154 A1 Oct. 27, 2005

(51) Int. Cl.
*E21B 43/25* (2006.01)

(52) U.S. Cl. ..... 166/184; 166/185; 166/202; 166/321; 166/325

(58) Field of Classification Search ..... 166/325, 166/319, 332.8, 334.4, 202, 185, 186, 184, 166/321
See application file for complete search history.

(56) References Cited

U.S. PATENT DOCUMENTS

| | | | | |
|---|---|---|---|---|
| 2,128,352 | A * | 8/1938 | Creighton | 175/65 |
| 2,846,015 | A * | 8/1958 | Pittman | 166/320 |
| 3,802,521 | A * | 4/1974 | Oliver | 175/318 |
| 3,902,361 | A | 9/1975 | Watson | 73/152.57 |
| 4,246,964 | A | 1/1981 | Brandell | 166/106 |
| 4,566,535 | A | 1/1986 | Sanford | 166/113 |
| 4,569,396 | A | 2/1986 | Brisco | 166/305.1 |
| 4,749,035 | A | 6/1988 | Cassity | 166/120 |
| 4,815,538 | A | 3/1989 | Burroughs | 166/312 |
| 4,886,117 | A | 12/1989 | Patel | 166/187 |
| 5,101,908 | A | 4/1992 | Mody | 166/387 |
| 5,143,015 | A | 9/1992 | Lubitz et al. | 166/187 |
| 5,267,617 | A | 12/1993 | Perricone et al. | 166/387 |
| 5,361,836 | A | 11/1994 | Sorem et al. | 166/187 |
| 5,383,520 | A | 1/1995 | Tucker | 166/142 |
| 5,392,851 | A * | 2/1995 | Arend | 166/65.1 |
| 5,398,755 | A | 3/1995 | Eslinger et al. | 166/187 |
| 5,692,564 | A | 12/1997 | Brooks | 166/127 |
| 5,722,490 | A | 3/1998 | Ebinger | 166/281 |
| 5,782,306 | A | 7/1998 | Serafin | 166/387 |
| 6,533,037 | B1 | 3/2003 | Eslinger | 166/319 |
| 6,571,876 | B1 * | 6/2003 | Szarka | 166/325 |
| 6,820,697 | B1 * | 11/2004 | Churchill | 166/374 |
| 2002/0153142 | A1 * | 10/2002 | Eslinger et al. | 166/305.1 |
| 2003/0019628 | A1 | 1/2003 | Ravensbergen | 166/308 |
| 2005/0247448 | A1 * | 11/2005 | Harper et al. | 166/202 |

OTHER PUBLICATIONS

SPE 68354 Formation Treating with Coiled-Tubing-Conveyed Straddle Tools; Richard Giroux, et al.
Baski, Inc. web pages at www.baski.com dated Jun. 24, 2002 (7 pages total).
"Product Report"—Baker Oil Tools; May 2000.
"Multiple Interval Selective Fracturing Tool"—Cardium Tool Services Inc.

* cited by examiner

*Primary Examiner*—Hoang Dang
(74) *Attorney, Agent, or Firm*—Howrey LLP

(57) ABSTRACT

An isolation assembly for use with coiled tubing is described. The isolation assembly has a check valve for providing selective fluid communication through from the coiled tubing, through the isolation assembly, and into a downhole tool, such a straddle packer. The isolation assembly includes a shuttle moveable within a housing, and plurality of ports to selectively provide fluid communication from within the isolation assembly below the check valve, through the ports, and into the annulus, thus allowing selective surface-controlled equalization of downhole equipment. Also described is a bottom hole assembly including the isolation assembly. An improved method of fracing a formation includes providing a check valve, thus improving the life of the coiled tubing and the safety of the operation, and reducing the time to perform a given downhole operation.

20 Claims, 2 Drawing Sheets

ISOLATION ASSEMBLY FOR COILED TUBING

BACKGROUND OF THE INVENTION

1. Field of the Invention

The present invention relates generally to downhole tools for use in wellbores. More particularly, this invention relates to an isolation assembly for use with coiled tubing operations, such as the pressure testing, matrix stimulation, or fracturing ("fracing") a well with a downhole tool, among other things.

2. Description of the Related Art

In the drilling and production of oil and gas wells, it is frequently necessary to isolate one subterranean region from another to prevent the passage of fluids between those regions. Once isolated, these regions or zones may be fraced or injected with a formation compatible fluid as required to stimulate production of hydrocarbons from the zones. Many stimulation techniques for given types of wells are better suited to using coiled tubing, as opposed to conventional jointed pipe intervention. Generally, it is known to attach a selective isolation device, such as a straddle packer, to coiled tubing and run the packing device downhole until the desired zone is reached. Once positioned, prior art fracing fluids or stimulation fluids may be forced into the zone.

In many downhole coiled tubing operations, it is known to use a check valve. Prior art check valves include the dual flapper back pressure valve product family H13204 from Baker Oil Tool, for example. Other types of check valves currently used include a ball and dart type check valve known to those of skill in the art. Generally, these check valves operate to provide a safety or control measure to prevent wellbore pressure from entering the coiled tubing work string. This feature is especially important when utilizing coiled tubing, as an unexpected surface failure of the coiled tubing may result in a surface release of wellbore fluids. The check valves are normally run directly below the coiled tubing connector.

However, in most operations, the check valve will not allow pressure below the check valve to be bled off at surface through the coiled tubing. Thus, for some operations performed with coiled tubing, it is not possible to utilize a check valve. For instance, fracturing operations using coiled tubing generally require that check valves are not run. This results in a potential flow path for the fluid in the coiled tubing and the formation (i.e. an uncontrolled release up the coiled tubing string) should the coiled tubing fail on surface. The resulting situation has a high potential of injury to personnel and other damage that may result in compromising well control. Thus, it is desirable to provide a check valve when fracturing or otherwise treating with coiled tubing to confine the potential release to just the coiled tubing volume above the check valve, such that the considerable volume of fluid in the formation would remain isolated.

Other operations (e.g. reverse circulating) cannot be performed efficiently utilizing a check valve with coiled tubing. For instance, and by way of example only, a traditional pressure test for a straddle packer cannot be performed when a check valve is used with coiled tubing. Generally, before beginning a fracturing or stimulation operation, a straddle packer is set in unperforated casing to ensure the integrity of the seal of the cups of the straddle packer. As shown in FIG. 1, straddle packers 10 are known to be comprised of two packing cups 11 and 12 mounted on a mandrel having a port 15. To test the integrity of the straddle packer 10, the straddle packer 10 is run into a non-perforated section of the wellbore casing 10, generally below the perforated zones.

To energize the straddle packer 10, pressurized fluid is pumped from surface through the coiled tubing 1, into the mandrel of the straddle packer, and out flow port 15 between cups 11 and 12. If the cups 11 and 12 function properly, the packer 10 will be set in the casing.

Once the integrity is ensured, the pressure in the coiled tubing is bled off, and the pressure between the cups 11 and 12 forces the fluid back into the coiled tubing to concomitantly reduce the pressure within the cups 11 and 12, as the straddle packer 10 is in direct communication with the coiled tubing. The straddle packer is then de-energized and free to move uphole to the perforated zone 5 to be fraced.

If a check valve were located between the straddle packer 10 and the coiled tubing string 1, then the pressure within the straddle packer 10 would create a pressure differential across the check valve such that the check valve would remain closed. Thus, no direct communication path would exist for the fluid to exit the straddle packer 10 and the straddle packer 10 would become fixed in the casing.

As stated above, fracing operations and other stimulation operations cannot be performed utilizing a check valve while a cup-type selective isolation device is used. Thus, when fracing or otherwise stimulating the well, it may be desirable to completely bleed down the pressure within the coiled tubing prior to attempting to move the tool below for various reasons, such as to improve the fatigue life of the coiled tubing and to improve the safety of the operation. However, in most applications, this 100% bleed down at surface is not commercially feasible, as the formation has been energized by the stimulation operation, and fluid communication is provided from the formation to surface. Thus, a complete bleed down at surface would require excessive time to complete, depending on the state of the formation.

In some applications, after each treatment, the coiled tubing may be bled down to allow the downhole tool to be re-positioned over another zone or pulled to surface. This may allow hazardous formation gas and fluids to enter the tubing, if no check valve is utilized. However, due to time constraints, in some operations the pressure in the coiled tubing is not bled down to be equalized with that in the annulus or completely bled down to atmospheric pressure (zero internal pressure in the coiled tubing). For instance, applied pressure within the coiled tubing may remain between 600 and 1000 p.s.i. while moving the packer. This may increase the wear on the cups 11 and 12 of the straddle packer 10. Further, it has been found that winding the coiled tubing on the spool at surface while the coiled tubing experiences these internal pressures may significantly accelerate the fatigue experienced by the coiled tubing and decreases the operational life of the coiled tubing, as shown on Table 1 described hereinafter. Thus, it would be desirable that the coiled tubing be allowed to be more completely bled down at surface prior to repositioning the downhole tool. In this way, pressure within the coiled tubing will not excessively fatigue the coiled tubing string as the string is wound around the spool at surface.

Thus, it would be desirable to provide an assembly for a downhole tool that would allow a check valve to be utilized in various downhole applications, such as when setting and using a straddle packer in fracing or other operations. Such an assembly would improve the operational life of the coiled tubing string, as well as increase the speed of performance of the given function, as operators at surface would not have to wait until the entire coiled tubing and formation are bled down from the straddle packer to surface. Finally, such a check valve would significantly increase the safety associated with performing these downhole operations.

The present invention is directed to overcoming, or at least reducing the effects of, one or more of the issues set forth above.

SUMMARY OF THE INVENTION

The invention relates to work done with coiled tubing, including in operations which utilize a downhole tool such as a straddle packer, or a single packer, or a cup packer, e.g., to isolate a part of the wellbore for fracturing (or fracing), stimulation methods, or other downhole methods using other types of downhole tools. In some embodiments, the frac fluid or stimulation fluid disclosed is nitrogen gas, liquid or gaseous carbon dioxide, water based fluids, hydrocarbon based fluids, or a mixture of any of these fluids, which may result in high pressures being generated. In some situations, no proppant is run to perform the treatments.

In some embodiments, after each treatment, the coiled tubing may be bled down to allow the downhole tool to be re-positioned over another zone or pulled to surface.

In some embodiments, utilizing the disclosed isolation assembly allows the internal surface coiled tubing pressure to be reduced to approximately zero (i.e. atmospheric pressure) in a timely manner before cycling the coiled tubing, which may significantly reduce the cost of pipe (by a factor of 6.8, per estimates, as shown on Table 1 hereinafter).

In some embodiments, the disclosed assembly may include check valve used above the downhole tool. In some embodiments, the check valve is a flapper type check valve pivotally attached within the isolation assembly. The isolation assembly is adapted to be held in a closed position (i.e. provide isolation up the coiled tubing string) by biasing the flapper valve closed with a flapper valve spring in normal operations (including while moving the downhole tool on the coiled tubing).

The isolation assembly in some embodiments includes a plurality of ports to provide fluid communication from inside the isolation assembly below the check valve to outside the downhole tool (i.e. communication to the annulus).

When the check valve moves from closed to open (i.e. when pressure is applied from surface via the coiled tubing string), the plurality of ports become unaligned and immediately close thus precluding fluid communication into the annulus. During the fracturing operation or stimulation operation, the act of pumping fluids though the coiled tubing opens the check valve within the isolation assembly (closed by differential pressure and then held open by pressure drop). A differential area is disclosed in some embodiments which ensures the check valve device is kept in the open position.

In some embodiments, an isolation assembly for associating a downhole tool with coiled tubing in a well bore is disclosed having a housing, a shuttle, a check valve, and biasing means. The housing may be adapted to associate the downhole tool with the coiled tubing, the housing having an inner diameter in fluid communication with an outer diameter via a housing port. The shuttle is slidably disposed within the housing, the shutter having an inner diameter in fluid communication with an outer diameter via a shuttle port. In some embodiments, the check valve is disposed within the isolation assembly adapted to selectively preclude fluid communication through the isolation assembly. And in some aspects, a biasing means is adapted to bias the shuttle within the housing such that the housing port is out of alignment with the shuttle port precluding fluid communication therethrough and into the annulus of the wellbore.

In some aspects, the check valve is biased in a closed position precluding fluid communication through the isolation assembly, the valve being openable by pumping fluid into the coiled tubing at a predetermined pressure. In some embodiments, the shuttle moves upwardly with respect to the housing when the upward force on the closed check valve exceeds the downward force of the biasing means.

A bottom hole assembly for a coiled tubing string is also described having a straddle packer with an upper cup and a lower cup, and an isolation assembly adapted to associate the straddle packer with the coiled tubing, the isolation assembly having a check valve adapted to selectively preclude fluid communication through the isolation assembly, a shuttle having a port moveably attached to a housing having a port, and a biasing means adapted to bias the shuttle within the housing such that the housing port is out of alignment with the shuttle port precluding fluid communication therethrough and into an annulus. As would be appreciated by one of ordinary skill in the art, other downhole tools and operations would benefit from utilizing embodiments disclosed herein, and as such, the apparatus and methods disclosed herein are not limited to using a straddle packer or performing a fracing operation, for example.

Further, a method of fracing or otherwise stimulating a formation is disclosed comprising connecting a packer to a coiled tubing string by an isolation assembly; straddling a zone to be fraced or stimulated with the packer on coiled tubing; setting the packer; pumping fluid through the coiled tubing, through the isolation device, and into the packer to fracture or treat the zone; bleeding back a pressure of the fluid in the coiled tubing string, thus closing a check valve in the isolation assembly, the packer remaining set; providing fluid communication through a plurality of aligned ports below the check valve in the isolation assembly and into the annulus, the fluid communication through the ports and into the annulus allowing the pressure inside the packer to equalize with the pressure of the annulus to unset the packer; and repositioning the packer within the casing.

Additional objects, features and advantages will be apparent in the additional written description that follows.

BRIEF DESCRIPTION OF THE DRAWINGS

The following figures form part of the present specification and are included to further demonstrate certain aspects of the present invention. The invention may be better understood by reference to one or more of these figures in combination with the detailed description of the specific embodiments presented herein.

Figure 1:
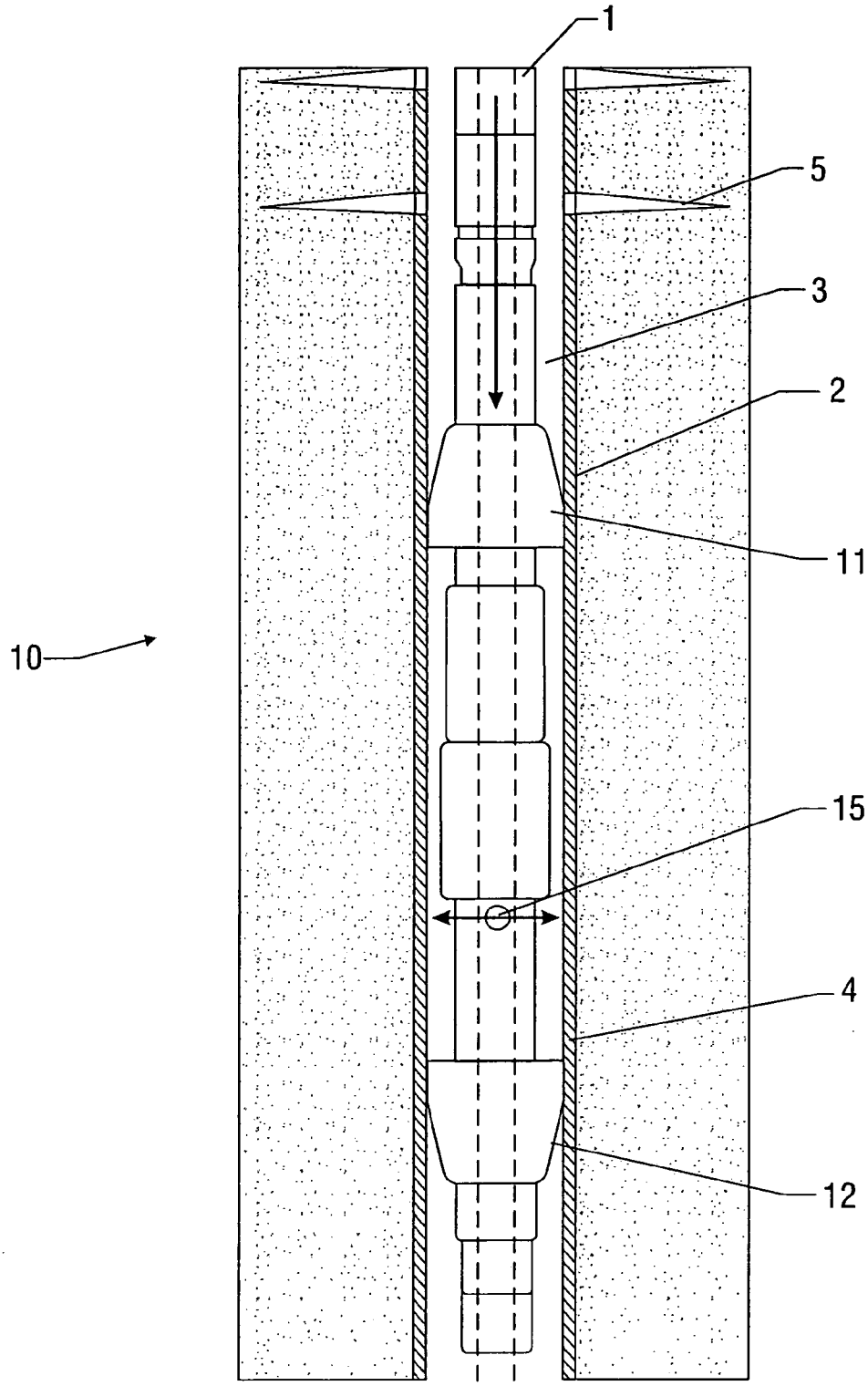
FIG. 1 (Prior Art)
FIG. 1 shows a prior art straddle packer.

While the invention is susceptible to various modifications an alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in performing an operation, such as performing a fracing or stimulation operation, for example. In the interest of clarity, not all features of an actual implementation are described in this specification. It will of course be appreciated that in the development of any such actual embodiment, numerous implementation specific decisions must be made to achieve the developers' specific goals which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

The present embodiments include an isolation assembly that may be utilized with coil tubing for the purpose of fracturing or stimulating a well, inter alia.

Embodiments of the invention will now be described with reference to the accompanying figures.

Figure 2:
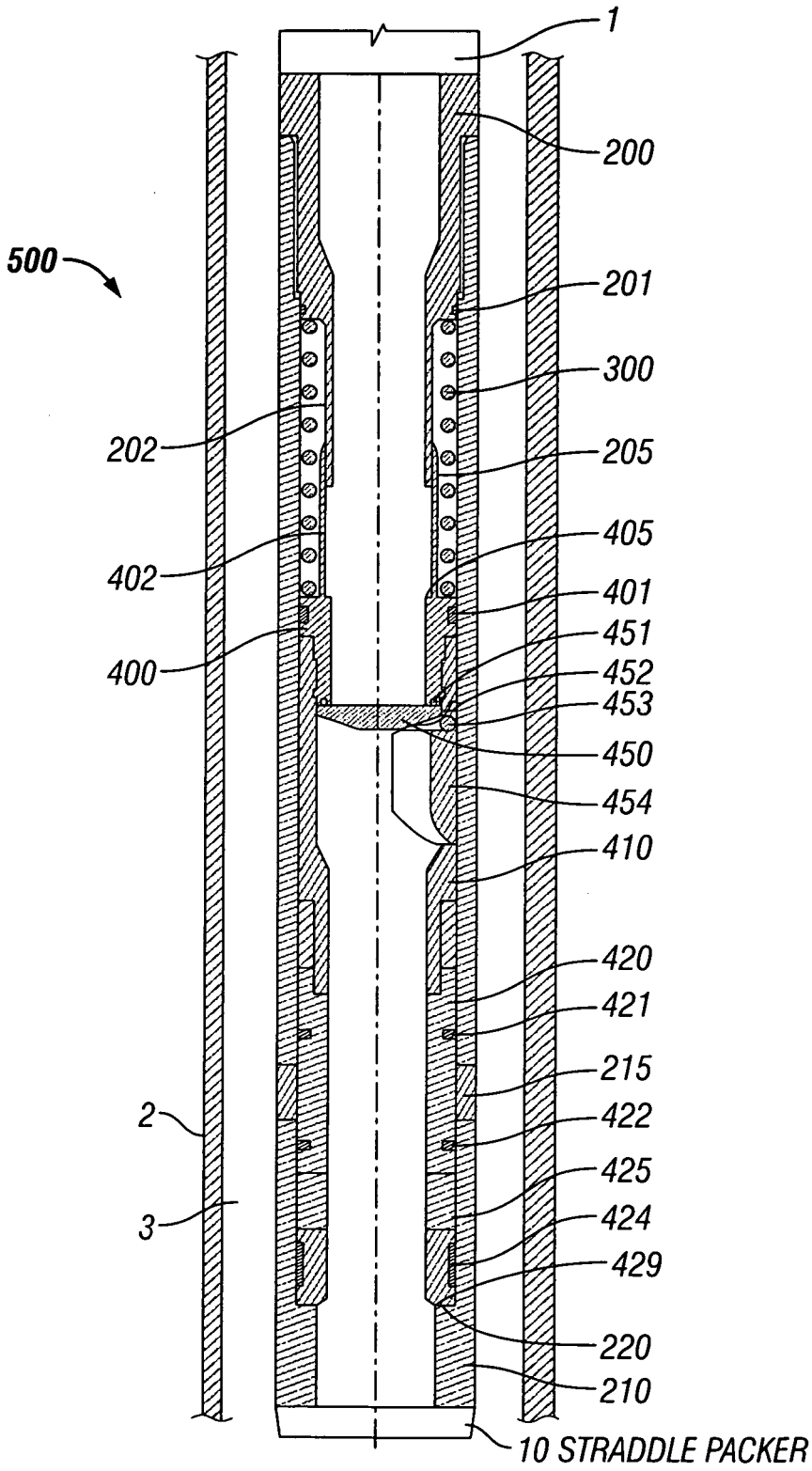
FIG. 2 shows an embodiment of the present disclosure having an isolation assembly including a check valve.

Referring to FIG. 2, one embodiment of the present invention is shown being utilized downhole within well casing 2. Annulus 3 is shown between the disclosed isolation assembly 500 and the casing 2. As shown, the isolating assembly 500 functionally associates a coiled tubing string 1 with any downhole tool, such as a straddle packer 10. Traditionally, the check valve is the first component directly attached to the coiled tubing string 1; so the disclosed isolation assembly (having a check valve) discussed herein is shown directly attached to the end of the coiled tubing string 1; however, such a construction is not required. In some embodiments, intermediate components may exist between the isolation assembly 500 and the coiled tubing 1, or between the isolation assembly 500 and the downhole tool. Thus, the isolation assembly 500 disclosed herein operates to associate the downhole tool such as the straddle packer 10 with the coiled tubing 1 as discussed herein.

The isolation assembly 500 is shown having a generally hollow inner diameter to provide fluid communication therethrough. As shown in FIG. 2, the isolation assembly 500 of the embodiment may be generally described as having a shuttle moveably attached to a housing, in general. The housing may be comprised of an upper body 200 and an external body 210. Thus, as shown, the housing may be adapted to provide an outer surface for the isolation assembly, to which the downhole tool, such as the straddle packer 10, may be fixedly attached.

Upper body 200 is connectable to the coiled tubing 1 above. External body 210 is shown threadedly engaged to the upper body 200. Ports 215 are shown on the lower end of the external body 210.

Upper body 200 also may comprise an upper body sleeve 202, the upper body sleeve 202 having a stop 205 on its end, as described more fully hereinafter. An o-ring 201 is disposed below the threaded engagement of the upper body to the external body 210 to seal the fluid to prevent the fluid from escaping into the annulus 3. As would be known to one of ordinary skill in the art having the benefit of this disclosure, the housing may be comprised of a unitary component, albeit possibly more difficult to construct, instead of the two (upper body 200 and external body 210) components of FIG. 2.

Disposed within the hollow external body 210 of the housing is a shuttle. The shuttle is moveably attached within the housing. The shuttle may be comprised of an upper shuttle body 400, check valve module 410, and lower shuttle body 420. Within the check valve module 410 of the shuttle is a check valve. In the embodiment shown, the check valve is comprised of a flapper check valve 450. However, any type of check valve, such as a gravity valve, e.g. could be utilized and the invention is not limited to include a flapper-type valve. The check valve may be biased in a closed position to preclude fluid communication through the hollow isolation assembly. Further, the check valve is adapted to close when a positive differential pressure exists below the check valve; and the check valve is adapted to open when the pressure above and below the check valve is equalized and any biasing force from the flapper spring 452, if utilized, is overcome, as would be known to one of ordinary skill in the art. That is, when pressurized fluid is supplied through the coiled tubing (either to frac a formation or to set the packer, e.g.), the check valve will open to allow fluid communication through the isolation assembly 500. In other words, the flapper check valve is adapted to open to allow fluid communication through the isolation assembly when a positive differential pressure (supplied via the coiled tubing) exists above the flapper check valve to overcome the biasing force of the flapper spring 452; and the flapper check valve is adapted to close when a positive differential pressure exists below the flapper check valve. And in embodiments that do not utilize the flapper spring 452, the flapper check valve is adapted to open to allow fluid communication through the isolation assembly when a positive differential pressure exists above the flapper check valve and the flapper check valve is adapted to close when a positive differential pressure exists below the flapper check valve.

As shown in FIG. 2, the upper shuttle body 400 of this embodiment may include an upper shuttle body sleeve 402 adapted to movingly engage the upper body sleeve 202. As the shuttle moves axially within the isolation assembly (described hereinafter), the upper shuttle body 402 is in sliding engagement with the upper body sleeve 202.

O-ring 401 is provided in the upper shuttle body 400 to provide sealing engagement with the external body 210 as the shuttle moves axially therewith. The upper shuttle body 400 is shown attached to the check valve module 410 by threaded engagement. Similarly, the lower shuttle body 420 is shown threadedly attached to the check valve module 410. Within the lower shuttle body 420 are ports 425.

In the embodiment shown, the flapper check valve 450 is pivotally attached to the check valve module 410. In the embodiment shown in FIG. 2, the flapper check valve 450 is in a closed position. The flapper check valve 450 is biased in the closed position by a flapper spring 452 in some embodiments. Flapper o-ring 451 is provided to seal the flapper check valve 450 against the upper shuttle body 400 when the flapper check valve 450 is closed. When the flapper check valve 450 is in an open position, the flapper check valve 450 pivots counterclockwise about pivot point 453 shown in FIG. 2, and may rest within the flapper recess 454 provided in the check valve module 410.

Of course, the shuttle may be comprised of a unitary component, instead of the multiple components described above, to which the check valve is attached, albeit possibly more difficult to construct.

As shown, the shuttle of the isolation assembly 500 is in its lowermost position such that the lower end 429 of the shuttle body lower 420 contacts a shelf 220 on the lower portion of external body 210. In this lowermost position, the seals 421 and 422 straddle the ports 215 in the external body 210 to provide a seal therefore; the o-rings 421 and 422 adapted to prevent fluid communication from within the isolation assembly 500 the annulus 3.

A shuttle spring 300 is shown in FIG. 2, which is adapted to bias the shuttle such that the port in the housing (i.e. port 215 in the external body 210) is out of alignment thus precluding fluid communication with the port in the shuttle (i.e. port 425 in the lower shuttle body 420). The shuttle spring 300 is shown circumscribing the upper body sleeve 202 and the upper shuttle body sleeve 402. The shuttle spring 300 is also shown within the external body 210.

The shuttle spring 300 is adapted to exert a downward force on the upper shuttle body 400, the shuttle spring 300 in compression and being positioned between the upper body 200 and the upper shuttle body 400. As the shuttle moves upwardly, the shuttle spring 300 becomes further compressed, thus increasing the downward force the shuttle spring 300 exerts upon the shuttle (via the upper shuttle body 400).

As described hereinafter, when the shuttle moves upwardly, the axial upward movement of the shuttle is limited by the stop 205 on the sleeve 202 of the upper body 205 contacting a shelf 405 on the sleeve 402 on the upper shuttle body 400. In this uppermost position, fluid communication is provided from within the isolation assembly below the flapper check valve 450 to the annulus 3, as the port 215 in the external body 210 and the port 425 in the lower shuttle body 420 are at least in partial alignment, fluid communication thus being allowed from within the lower shuttle body 420 to the annulus 3.

When the shuttle moves upwardly such that isolation assembly 500 is in the open position, fluid communication is provided from within the assembly 500 below the closed flapper check valve 450, through the port 425 in the lower shuttle body 420, through the port 215 in the external body 210, and into the annulus 3. I.e., when the ports 415, 215 of the shuttle and the housing are at least in partial in alignment, the isolation assembly 500 is in an open position such that fluid communication is provided from within the isolation assembly 500 to the annulus 3.

The operation of the isolation assembly 500 will now be discussed. The isolation assembly 500 functionally associates the coiled tubing 1 with a downhole tool, such as straddle packer 10. In the embodiment of FIG. 2, the isolation assembly 500 is connected, directly or indirectly, to the coiled tubing string 1. Generally, the isolation assembly is the first downhole component attached to the coiled tubing, as the isolation assembly includes a check valve. However, other intermediate components may be connected to the coiled tubing before the connecting the isolation assembly of the embodiment of FIG. 2. Further, while the discussion of the operation of the isolation assembly 500 is in conjunction with the straddle packer 10, the straddle packer is an exemplary tool, and the disclosure of the isolation assembly 500 herein is not limited to operation of the straddle packer 10. The isolation assembly may be utilized with any type of downhole tool. For example, the isolation assembly may be utilized with any type of downhole tool such as a straddle packer or any tool where hydraulic locking may occur that would affect the functionality of the tool.

The downhole tool such as the straddle packer 10 and the isolation assembly 500 are lowered into the casing by unreeling the coiled tubing 1 from surface. Once the tool such as the straddle packer 10 reaches a desired location, the straddle packer 10 is set. For instance, when pressure testing the straddle packer 10, the downward descent into the wellbore ceases when the straddle packer 10 reaches a lower unperforated section of the casing, typically below the perforated layers 5. Alternatively, when performing a fracing, stimulation, or other operation, the downward descent into the wellbore ceases when the straddle packer 10 straddles the perforated zone 5 to be stimulated.

When running in hole, no fluid is generally pumped within the coiled tubing string 1 downhole, to the isolation assembly 500 or the downhole tool such as the straddle packer 10. Thus, the check valve is in a closed position, as the check valve is biased in a closed position by a spring 452. Further, without pumping fluid within the coiled tubing 1, a pressure differential develops across the check valve, also functioning to close the valve as the positive differential pressure exists below the valve. Further, when running in hole, the shuttle of the isolation assembly is generally disposed within the housing in a lower position within the isolation assembly, as shown in FIG. 2. As such, fluid communication through the ports of the shuttle and housing (i.e. the ports 425 of the lower shuttle body 420 and the ports 415 in the external body 210) is precluded.

When it is desired to commence the pressure test (or when it is desired to perform the fracing or stimulation operation), fluid such as pressurized nitrogen gas is supplied within the coiled tubing 1 from surface. The pressure of the fluid in the coiled tubing acts to eliminate any pressure differential across the check valve 450, and to overcome the biasing force of the flapper spring 452, such that the flapper check valve 450 opens to allow fluid communication through the isolation assembly 500. Thus, fluid from the coiled tubing passes through the hollow isolation assembly 500, and into the straddle packer 10, and out of the port 15 in the straddle packer 10 (as shown in FIG. 1). The pressure supplied between the upper cup 11 and lower cup 12 of the straddle packer 10 acts to energize the straddle packer 10 within the casing.

Once set, the integrity of the straddle packer 10 may be confirmed by procedures known to one of ordinary skill in the art. Or, when performing a fracing or stimulation operation, as fluid is passed into the straddle packer 10, the fluid may pass into the perforations 5 to stimulate the zone. Or when other operations, the fluid may pass through to coiled tubing into the downhole tool, to turn a mud motor or mill, for example. Or in other operations where the fluid may pass through the coiled tubing into the downhole tool, hydraulic locking may occur that would affect the functionality of the tool.

At some point (e.g. when the pressure test is complete, or when the fracing/stimulation job or other downhole operation is complete), pressurized fluid is no longer supplied to the coiled tubing 1 at surface, and the pressure within the coiled tubing is reduced or "bled off" at surface. When the pressure is bled off, a pressure differential across the check valve is created, acting to close the check valve, in further with the biasing spring operating to bias the check valve closed. In the embodiment shown, the flapper check valve 450 pivots out of the flapper recess 454, about pivot point 453, to close the central opening within the isolation assembly 500. In the embodiment shown, the flapper check valve 450 pivots about pivot point 453 to contact the upper shuttle body 400 the flapper o-ring 451 sealing the connection therebetween. With the check valve in the closed position, the coiled tubing may be bled off all the way down in a timely fashion, the check valve preventing fluid communication from downhole through the isolation assembly. Thus, the internal pressure within the coiled tubing advantageously can be minimized to atmospheric pressure and certainly below the 600–1000 p.s.i. currently utilized. The reduction of pressure within the coiled tubing as the coiled tubing string is wrapped around the spool at surface has been found to reduce fatigue stresses on the coiled tubing, as well as to increase the operational life of the coiled tubing.

With the flapper check valve 450 in a closed position, and when pressurized fluid is no longer being supplied from surface, an upward force is generated acting upon the flapper check valve 450. This upward force is due to the pressure differential existing over the check valve, for example.

When this upward force is sufficient to overcome the downward force of the biasing means, such as the shuttle spring 300 in this embodiment, the shuttle begins to move upwardly with respect to the housing. Specifically, the upper shuttle body 400, the check valve module 410 having the flapper check valve 450, and the lower shuttle body 420 move upwardly with respect to and within the external body 210 and the upper body 200 of the housing. The upper body 200 and the external body 210 remain stationary in the casing 2, as does the straddle packer 10.

The sleeve 402 on the upper shuttle body 400 slides moveably along the sleeve 202 of the upper body 200. O-rings 421 and 422 provide a seal across ports 215 of the external body 210 to preclude fluid communication from the annulus through the housing.

With the continued application of the upward force (due to the pressure differential), the shuttle continues traversing axially upwardly within the housing. This upward movement of the shuttle continues until the stop 205 on the upper body 200 contacts the shelf 405 on the upper shuttle body 400 in this embodiment. As would be realized by one of ordinary skill in the art having the benefit of this disclosure, other constructions could be supplied to limit the upward movement on the shuttle, such as having a stop on the upper shuttle body 405 contacting a shelf on the upper body 205, e.g.

Concomitantly with the upward limit of the shuttle, the ports 215 in the external body 210 align with ports 425 in the lower shuttle body 420. When ports 215 and 425 align, at least partially, fluid communication therethrough is provided. O-rings 422 and 424 are provided on the lower shuttle body 420 to provide sealing engagement between the lower shuttle body 420 and the external body 210 of the housing.

It is noted that complete alignment is not required. Provided that the ports 215 and 225 are at least in partial alignment, fluid communication therethrough is provided and the isolation assembly is considered to be in the open position.

Thus, higher pressure gas trapped between the upper cup 11 and lower cup 12 of the saddle packer is allowed to escape through ports 215 and 225 and into the annulus 3. Once the higher pressure gas passes through ports 215 and 225 an into the annulus 3, the packer cups 11 and 12 deflate such that the packer 10 is no longer engaging the wellbore and the tool may be re-positioned to a new location in the casing. Further, with the escape of the higher pressure gas, the upward force on the flapper check valve 450 is reduced.

When this upward force is reduced a sufficient amount, the biasing force of the shuttle spring 300 overcomes the upward force, such that the shuttle begins to move downwardly. Providing the biasing force of the shuttle spring 300 is greater than the upward force applied to the flapper check valve 450, the shuttle will continue to move downwardly. The downward movement of the shuttle is limited in this embodiment; once the lower end 429 of the lower shuttle body 420 contacts shelf 220 on the external body 210 of the housing.

Once the straddle packer 10 is de-energized, the upper cup 11 and the lower cup 12 no longer engage the casing 2. At this point, the straddle packer 10 is no longer lodged in the casing, and the straddle packer 10 may be moved to a zone to be stimulated by pulling on the coiled tubing 1. Once the straddle packer 10 is at the desired location within the casing, pressurized fluid such as nitrogen may be applied to the coiled tubing. When this pressure is supplied to the coiled tubing 1, the flapper check valve 450 opens, as the pressure differential across the flapper check valve 450 is no longer present as described above. The pressurized nitrogen flows through coiled tubing, through the isolation assembly 500, and out of port 15 in the straddle packer 10 to energize the straddle packer 10, the upper cup 11 and the lower cup 12 engaging the casing 2.

In this way, the straddle packer 10 may be pressure tested, and subsequently moved (repeatedly, if desired) from zone to zone, while allowing the operator to significantly bleed down the pressure of the gas in the coiled tubing prior to movement. The ability to significantly bleed down the pressure in the coiled tubing prior to repositioning the tool and reeling the coiled tubing on and off the coiled tubing spool significantly reduces the fatigue experienced by the coiled tubing, thus increasing the operational life of a given coiled tubing string.

Examples of the increases in the life of typical coiled tubing are provided below:

TABLE 1

Fatigue Life Improvements

| Pressure in CT when moved | Jobs per CT string | Approximate cost |
|---|---|---|
| 1000 p.s.i. | 19 | $0.335/foot run |
| 500 p.s.i. | 29 | $0.207/foot run |
| 0 p.s.i. | 142 | $0.049/foot run |

By utilizing the above isolation assembly, fatigue life may be significantly increased, as shown in the Table 1. For instance, for 70 grade (70,000 p.s.i.) 2⅞" diameter coiled tubing, having 0.190" wall thickness, the operational life may double. Using this isolation device which allows the internal coiled tubing pressure to be reduced to zero in a timely manner before cycling the coiled tubing may reduce the cost by as mush as a factor of six, and extend the lift of each coiled tubing string accordingly. Further, as the check valve prevents fluid communication downhole, through the isolation assembly 500, to surface, the bleeding off process is faster and more efficient than systems without the check valve.

Further, by using the disclosed isolation assembly 500, stimulation fluid of either nitrogen gas, liquid or gaseous carbon dioxide, water based fluids, hydrocarbon based fluids, or a mixture of any of these fluids may be more safely utilized. In some situations, no proppant is run in the fracing operations disclosed herein.

Finally, the use of the check valve in these disclosed operations provides improved safety for the operation. Rather, should an unexpected coiled tubing surface failure or other event develop, the check valve simply will close, thus protecting the persons and equipment at surface.

As stated above, with prior art devices, fracturing operations using coiled tubing generally require that check valves are not run. This results in a potential flow path for the energized fluid in the coiled tubing and the formation (i.e. an uncontrolled release up the coiled tubing string) should the coiled tubing part on surface. The resulting situation has a high potential of injury to personnel and other damage that may result in compromising well control.

By incorporating the isolation assembly 500, the potential release from the downhole will be confined to the fluid only above the check valve of the isolation assembly 500. Thus the considerable volume of energized fluid in the formation remains isolated.

It should be noted that above method of operation for the isolation assembly is not restricted to the pressure testing operation of the straddle packer 10. For instance, when the straddle packer 10 is used for stimulating a formation, the cups 11 and 12 straddle the perforations in the casing. When the pressurized fluid is no longer supplied to the coiled tubing, the check valve closes because of the pressure differential, the pressure above the check valve being less than the pressure below. Further, as stated above, the isolation assembly including the check valve is not limited for use with a straddle packer; rather, the isolation assembly including the check valve is adapted for use with any downhole tool known to one of ordinary skill in the art having the benefit of this disclosure.

While the structures and methods of this invention have been described in terms of preferred embodiments, it will be apparent to those of skill in the art that variations may be applied to the process described herein without departing from the concept, spirit and scope of the invention. All such similar substitutes and modifications apparent to those skilled in the art are deemed to be within the spirit, scope and concept of the invention as it is set out in the following claims.

The following table lists the description and the numbers as used herein and in the drawings attached hereto.

| Reference Designator | Component |
|---|---|
| 1 | Coiled Tubing |
| 2 | Casing |
| 3 | Annulus |
| 4 | Non-perforated Section |
| 5 | Perforations |
| 10 | Straddle Packer |
| 11 | Upper Cup of Straddle Packer |
| 12 | Lower Cup of Straddle Packer |
| 15 | Port in Straddle Packer |
| 200 | Upper Body |
| 201 | O-ring |
| 202 | Sleeve on Upper Body |
| 205 | Stop on Upper Body |
| 210 | External Body |
| 215 | Port in External Body |
| 220 | Shelf on Sleeve of External Body |
| 300 | Shuttle Spring |
| 400 | Upper Shuttle Body |

-continued

| Reference Designator | Component |
|---|---|
| 402 | Sleeve on Upper Shuttle Body |
| 404 | Shelf on Sleeve of Upper Shuttle Body |
| 410 | Check Valve Module |
| 420 | Lower Shuttle Body |
| 421 | O-ring |
| 422 | O-ring |
| 424 | O-ring/seal |
| 425 | Port in Lower Shuttle Body of Shuttle |
| 429 | Lower end of Lower Shuttle Body |
| 450 | Flapper Check Valve |
| 451 | O-ring |
| 452 | Flapper Spring |
| 453 | Pivot Point |
| 454 | Flapper Recess |
| 505 | Isolation Assembly |

What is claimed is:

1. An isolation assembly for associating a downhole tool with coiled tubing of a well bore, comprising:

a housing adapted to associate the downhole tool with the coiled tubing, the housing having an inner diameter in fluid communication with an outer diameter via a housing port;

a shuttle slidably disposed within the housing, the shuttle having an inner diameter in fluid communication with an outer diameter via a shuttle port;

a check valve within the isolation assembly adapted to selectively preclude fluid communication through the isolation assembly, the check valve being a flapper check valve pivotally attached to the shuttle, the flapper check valve adapted to open to allow fluid communication through the isolation assembly when a positive differential pressure supplied via the coiled tubing exists above the flapper check valve, the flapper check valve adapted to close when a positive differential pressure exists below the flapper check valve; and a biasing means adapted to bias the shuttle within the housing such that the housing port is out of alignment with the shuttle port precluding fluid communication therethrough.

2. The assembly of claim 1 in which the housing further comprises:

an upper body having an upper body sleeve moveably attached to the shuttle; and an external body attaching the upper body to the downhole tool, the housing port being within the external body.

3. The assembly of claim 2, in which the shuttle further comprises:

an upper shuttle body having a sleeve movably attached to the sleeve on the upper body;

a check valve module for housing the check valve; and a lower shuffle body, the shuffle port being located in the lower shuttle body.

4. The assembly of claim 3, in which the check valve is biased in a closed position precluding fluid communication through the isolation assembly, the valve being openable by pumping fluid into the coiled tubing to generate a positive differential pressure above the check valve.

5. The assembly of claim 3 in which the check valve is biased closed by a flapper check valve spring, thus precluding fluid communication through the isolation assembly.

6. The assembly of claim 1, in which the flapper check valve is biased in a closed position by a biasing force of a flapper check valve spring pivotally attached to the shuttle assembly, the flapper check valve adapted to open when the positive differential pressure that exists above the flapper check valve is sufficient to overcome the biasing force of the flapper check valve spring.

7. The assembly of claim 6 in which a differential pressure is generated across the check valve when pressure within the coiled tubing string is reduced, thus closing the check valve, an upward force being exerted on the check valve when in a closed position.

8. The assembly of claim 7 in which the shuttle moves upwardly with respect to the housing when the upward force on the closed check valve exceeds the downward force of the biasing means.

9. The assembly of claim 8 in which the upward movement of the shuttle is limited by a stop on the upper body contacting a shelf on the upper shuffle body.

10. The assembly of claim 8 defining an open position of the isolation assembly when the shuttle port and the housing port are at least partially aligned, providing fluid communication therethrough, out of the isolation assembly below the check valve and into an annulus.

11. The assembly of claim 6 in which the shuffle further comprises a cheek valve module having a flapper recess, the flapper recess adapted to envelope the flapper when the flapper check valve is open to allow fluid communication through the assembly.

12. The assembly of claim 6, in which the biasing means comprises a spring surrounding the sleeve of the upper body and the sleeve on the upper shuffle body.

13. The assembly of claim 12, in which the spring is in compression and is disposed between the upper body and the upper shuttle body, thereby supplying a downward force on the upper shuffle body.

14. The assembly of claim 13 in which the downward movement of the shuffle is limited by a lower end of the lower shuffle body contacting a shelf on the external body of the housing.

15. The assembly of claim 1 in which the downhole tool is a straddle packer.

16. A bottom bole assembly for a coded tubing siring, comprising:

a straddle packer having an upper cup and a lower cup; and an isolation assembly adapted to associate the straddle packer with the coiled tubing, the isolation assembly having a check valve adapted to selectively preclude fluid communication through the isolation assembly, a shuttle having a port moveably attached to a housing having a port, and a biasing means adapted to bias the shuttle within the housing such that the housing port is out of alignment with the shuttle port precluding fluid communication therethrough and into an annulus.

17. The bottom hole assembly of claim 16 in which the housing further comprises:

an upper body having an upper body sleeve moveably attached to the shuttle; and an external body attaching the upper body to the straddle packer, the housing port being within the external body.

18. The assembly of claim 17, in which the shuttle further comprises:

an upper shuttle body having a sleeve movably attached to the sleeve on the upper body of the housing;

a check valve module for housing the check valve; and a lower shuffle body, the shuffle port being located in the lower shuttle body.

19. The assembly of claim 18, in which the check valve is biased in a closed position precluding fluid communication through the isolation assembly, the valve being openable by pumping fluid into the coiled tubing string to generate a positive differential pressure above the cheek valve.

20. The assembly of claim 16, in which the check valve is a flapper check valve pivotally attached to the shuttle, the flapper check valve adapted to open to allow fluid communication through the isolation assembly when a positive differential pressure supplied via the coiled tubing string exists above the flapper check valve, the flapper check valve adapted to close when a positive differential pressure exists below the flapper check valve.

* * * * *

UNITED STATES PATENT AND TRADEMARK OFFICE

CERTIFICATE OF CORRECTION

PATENT NO. : 7,134,488 B2
APPLICATION NO. : 10/829601
DATED : November 14, 2006
INVENTOR(S) : Eric Hughson Tudor and William George Gavin It is certified that error appears in the above-identified patent and that said Letters Patent is hereby corrected as shown below:

Column 12:

In claim 3, line 58, change “shuffle” to --shuttle-- (two occurrences).

Column 13:

In claim 9, line 19, change “shuffle” to --shuttle--.

In claim 11, line 25, change “shuffle” to --shuttle--

In claim 12, line 32, change “shuffle” to --shuttle--.

In claim 13, line 36, change “shuffle” to --shuttle--.

In claim 14, line 38 and 39, change “shuffle” to --shuttle--.

Column 14:

In claim 16, line 1, change “siring” to --string--.

In claim 18, line 25, change “shuffle” to --shuttle-- (two occurrences).

In claim 19, line 31, change “cheek” to --check--.

Signed and Sealed this

Ninth Day of January, 2007

JON W. DUDAS
*Director of the United States Patent and Trademark Office*